United States Patent [19]

Divecha

[11] 4,060,412

[45] Nov. 29, 1977

[54] METHOD FOR PREPARING A FIBER REINFORCED METAL MATRIX USING MICROSCOPIC FIBERS

[75] Inventor: Amarnath P. Divecha, Falls Church, Va.

[73] Assignee: A Silag Inc., McMurray, Pa.

[21] Appl. No.: 647,442

[22] Filed: Jan. 8, 1976

[51] Int. Cl.[2] ..... B22F 3/00

[52] U.S. Cl. ..... 75/203; 75/226; 75/DIG. 1; 29/419 R; 264/332

[58] Field of Search ..... 75/226, 203, DIG. 1; 29/419; 264/332

[56] References Cited

U.S. PATENT DOCUMENTS

| | | | |
|---|---|---|---|
| 3,441,392 | 4/1969 | Divecha et al. | 75/DIG. 1 |
| 3,471,270 | 10/1969 | Carlson | 75/DIG. 1 |
| 3,833,697 | 9/1974 | Lare et al. | 29/182.8 |

OTHER PUBLICATIONS

Hamby, DMIC Review of Recent Development, 10--8-69.

Divecha, et al., Technical Report, AFML-TR-69-7, May, 1969.

*Primary Examiner*—Brooks H. Hunt

*Attorney, Agent, or Firm*—Daniel W. Sixbey; Kenneth P. Glynn

[57] ABSTRACT

Microscopic fibers are mixed with a metal powder to provide a nonuniform mixture with randomly oriented fibers having metal particles adhered thereto. This mixture is extruded at room temperature at least three times, and is then placed in a die cavity and subjected to a first pressure at room temperature. While adding no additional pressure, the die cavity is heated to bring the mixture to a temperature above the solidus of the metal powder, and the volume of the die cavity is decreased to at least the theoretical volume necessary to receive the mixture if the mixture included no voids. The die cavity is then cooled and the resultant billet ejected therefrom.

11 Claims, No Drawings

METHOD FOR PREPARING A FIBER REINFORCED METAL MATRIX USING MICROSCOPIC FIBERS

BACKGROUND OF THE INVENTION

Increasing demands for very strong, lightweight metals have fostered the development of a number of techniques for producing fiber reinforced metal composites. The effective incorporation of high strength single crystal fibers or whiskers in a metal matrix results in a combination of the mechanical properties of the metal with those of the high strength fibers. For example, normal metallurgical processes can produce a metal alloy of enhanced strength, but the stiffness of the metals will remain the same. However, if whiskers of silicon carbide, which has a stiffness of approximately 75 million psi, are combined with aluminum, which has a stiffness of approximately 10 million psi, a metal composite having a stiffness much greater than that of aluminum will result. Such a composite consisting of 80 percent by volume of aluminum and 20 percent by volume of silicon carbide whiskers would have a stiffness substantially equal to that of steel with no appreciable increase in weight. This would provide aluminum having the stiffness of steel but the corrosion resistance and light weight of aluminum.

Many of the difficulties encountered in the production of a fiber reinforced metal composite and novel methods for resolving these difficulties are disclosed in my issued U.S. Pat. Nos. 3,441,392; 3,498,890; 3,668,748; 3,828,417 and 3,833,697. While the processes disclosed in these patents are highly advantageous over processes disclosed in the art prior thereto, these processes all relate to the production of metal composites using whiskers of relatively large size. The whiskers employed in these processes were of a diameter in the tens of micron range; normally up to 30 microns, and had lengths of up to one half inch. Subsequently, ceramic fiber technology has advanced to a point where microscopic whiskers having diameters extending from the submicron range to an upper limit of under ten microns are readily available. VM0032 graphite whiskers marketed by Union Carbide Company are available in diameters ranging from 1 to 9 microns, while silicon carbide whiskers marketed by Exxon Enterprises of Salt Lake City, Utah, have diameters in the submicron range of from 500 to 1000 angstroms.

Microscopic whiskers used as reinforcement for a metal will provide a superior metal composite product. A uniform dispersion of these whiskers throughout a composite will provide a large number of strength imparting fibers for any given area. For example, in umcombined form, about 250 million of the Exxon silicon carbide fibers will occupy only about one cubic inch. The length of these fibers is less than the diameter of the fibers conventionally used in known metal composite forming processes.

Heretofore, microscopic ceramic whiskers having diameters extending from the submicron to below 10 micron range have been found to be unsuitable for use in metal matrix composites. For example, with silicon carbide fibers having diameters of 500 – 1000 angstroms, it is difficult to bond epoxy or molten plastic around the fibers without creating holes or voids, and with metal powder, this difficulty is multiplied. It is necessary to uniformly disperse the fibers throughout the metal powder and to then maintain this uniform dispersion as the powder-fiber mixture is placed in a die cavity for molding.

It is a primary object of the present invention to provide a novel and improved process for making a metal matrix composite reinforced with very fine microscopic fibers.

Another object of the present invention is to provide a novel and improved process for making a metal matrix composite wherein reinforcing fibers having a diameter of less than 10 microns are effectively employed as reinforcing whiskers.

A further object of the present invention is to provide a novel and improved process for making a metal matrix composite wherein very fine microscopic fibers are mixed with metal powder and a mixing vehicle and are then extruded at room temperature a plurality of times to achieve a substantially uniform distribution of fibers throughout the metal matrix. The mixing vehicle is then removed from the mixture while the distribution is maintained.

A still further object of the present invention is to provide a novel and improved process for making a metal matrix composite wherein a mixture of very fine microscopic fibers evenly dispersed throughout a metal powder is obtained and processed in a die cavity to produce a fiber reinforced metal billet.

These and other objects of the present invention will become readily apparent from a consideration of the following specification and accompanying claims.

Broadly, the process of the present invention is initiated by setting up a basic metal powder and fiber mixture. The metal matrix should constitute fine metal powder of less than minus 200 mesh with minus 325 mesh powdered metal being preferred. Suitable metal powders are specified in my prior U.S. Pat. Nos. 3,441,392, 3,668,697 and 3,833,697, and are incorporated herein by reference. Also pure aluminum powder and aluminum powder compositions in the minus 325 mesh range designated 6061, 2024, 7075, 5052 and 1100 may be obtained from Reynolds Aluminum Company, Richmond, Virginia.

The fiber and metal powder are first weighed so that the fiber constitutes 10 to 30 percent of the total volume of the mixture. The preferred fiber volume is approximately 20 percent, as this has been found the easiest to incorporate into a metal matrix. As previously indicated, the fiber is of a diameter of less than 10 microns and might constitute graphite or silicon carbide fibers. These fibers are microscopic and in a random oriented form. Individual fibers have no apparent length unless viewed under a microscope.

After the fiber and metal powder portions are determined by weighing, they are placed in a large container and agitated. Ideally, this agitation will occur in a molten camphene vehicle for between 5 and 15 minutes. The volume of camphene employed must at least equal and preferably exceeds the total volume of the fiber-metal powder mixture.

A vehicle such as camphene has been found to be useful once the microscopic fibers have been dispersed and oriented in the metal matrix to maintain the fiber dispersion and orientation. The vehicle employed for this purpose must have a low melting point, must not react with the metal matrix employed, must evaporate leaving substantially no residue and must be able to be extruded at room temperature.

Crude camphene sold by either the Eastman Kodak Company or the Glidden Durkee Company is readily available, but crude camphene has been found to attack aluminum and other metal powders. However, a simple vacuum distillation of crude camphene renders it suitable for use in the process of this invention. It has been found that distilled camphene obtained by subjecting crude camphene to only one vacuum distillation cycle operates effectively as a suitable vehicle, although purer distilled camphene obtained from a plurality of distillation cycles is even more preferable.

Distilled camphene melts at approximately 52° C, and molten distilled camphene is inserted into the mixing container with the measured portions of metal powder and microscopic fiber. After agitation and mixing in the container for from 5 to 15 minutes, the resultant mixture is cooled under refrigeration until all of the camphene solidifies.

The refrigerated mixture of metal powder and fibers in the camphene vehicle is extremely poor at best. The fibers are much lighter than the metal matrix, and generally the fiber size and shape and metal powder particle sizes vary markedly. If a sound, composite metal billet is to be obtained from this mixture, the fiber must be evenly distributed throughout the metal matrix.

To achieve good fiber-metal powder distribution, the refrigerated mixture is extruded at room temperature after the camphene vehicle has solidified. The refrigerated block containing the mixture is extruded through a conventional extrusion die, and this process of extrusion is repeated at least three times. The plurality of extrusions of the mixed material results in an excellent distribution of the microscopic fibers throughout the metal powder matrix. Although a minimum of three extrusions is required, additional extrusions can be accomplished until the best distribution is obtained. After three extrusions have been accomplished, the fiber distribution should be checked with a microscope and should be rechecked after each additional extrusion step.

Once the extrusion process has been completed, the camphene-fiber-powder mixture is placed in a vacuum chamber and the chamber is evacuated to cause vacuum evaporation of the camphene. The evaporated camphene may be retained and reused, and when all camphene is evaporated from the mixture, the now dry mixture is ready for consolidation into billets.

The apparatus for billet preparation is quite conventional and includes a cylindrical steel or graphite die, a punch or plunger, a heater, a thermocouple for temperature measurement and a (hydraulic) press. Such an apparatus suitable for use in accomplishing the present method is shown in my U.S. Pat. No. 3,441,392.

The dry mixture is gently poured into the die cavity, and the metal powder, apparently only loosely attached to the fibers, does not segregate. It is likely that the residual thin oil film left from the camphene constituents may be responsible for this beneficial behaviour. If the mixture were to segregate, the distribution would suffer and billet quality would be poor.

After the die cavity has been filled with the mixture, a punch is placed in the cavity and a pressure of at least 500 psi and preferably of from 1000 to 1500 psi is applied to the mixture by means of the punch. Once again, because of the film left by the mixing vehicle over the powder and the fiber, the damage to the fiber due to this load is minimal, for apparently, the film acts as a lubricant. It is important to note that unlike the process described in U.S. Pat. No. 3,441,392, the process of this invention involves the application of pressure to the mixture in the die cavity while the mixture is at room temperature.

The whole die assembly is now quickly heated to a temperature above the melting point of the metal powder with the punch in place but with little or no additional pressure on the punch. A calculated second pressure is now applied. Since the volume of the die and the amount of mixture in the die are known, the volume that the mixture would occupy if 100% densified is calculated. For example, 2.7 grams of aluminum will occupy a volume of 1 cubic centimeter if free of voids. Similarly, 2.7 grams of aluminum with 3.17 grams of silicon carbide fibers will occupy 2 cubic centimeters if free of voids. By using the Law of Mixtures to calculate the volume that the mixture within the die would occupy if free of voids, the necessary punch movement into the die to leave only this void free volume can be calculated. Thus the necessary punch movement which is to occur after the die cavity has been heated to cause the mixture to pass into a semi molten stage is precalculated. Whatever pressure that is needed to move the punch downward to that distance is utilized and it generally exceeds 2000 psi. All the air is expelled from the mixture and the molten metal encapsulates the fibers simultaneously. The ram travel is deliberately approximately 5 percent more than that calculated to assure complete densification, and the excess molten metal escapes from the die via the annular space between the die and the punch.

The 5% excess travel of the punch within the die cavity may be easily obtained by making the volume calculations at room temperature. Since the mixture within the die cavity is heated when pressure is reapplied thereto, thermal expansion of the mixture provides the slight excess needed to assure that the pressed billet is substantially free of voids. The pressure is maintained and the die and billet are allowed to cool. The cool billet is then ejected from the die and is ready for use.

The temperatures necessary to bring various metal-fiber mixtures to a semi-molten state for the final pressure step are completely discussed in my U.S. Pat. Nos. 3,441,392 and 3,833,697, and the apparatus and temperatures discussed in those patents are used to perform the method of the present invention. As previously stressed, the present method of forming the finished billet differs from that disclosed in the aforementioned patents in that pressure is first applied to the mixture in the die at room temperature. The die is then retained against the initially compressed mixture while the temperature of the die cavity is raised to cause the mixture to pass into the semi-molten state discussed in the aforementioned patents. Then the punch is driven to the predetermined point in the die to achieve the desired billet densification.

When microscopic fibers have been evenly dispersed throughout a metal powder-fiber mixture, they may be subjected to pressure at room temperature without damaging the fibers. This cold pressure step is extremely advantageous, as it removes most of the voids in the mixture before heating and consequently eliminates any substantial relative movement between the metal powder particles and the fibers which might occur after heating to upset the even dispersal of fibers throughout the semi-molten mixture. The application of significant pressure to the mixture before heating compresses the mixture and makes it easier to maintain an even temperature throughout the mixture during the subsequent pressure step as the mass of the mixture to be heated is now much smaller.

The process of the present invention has been employed effectively with both microscopic graphite and silicon carbide fibers in the manner indicated by the following examples.

EXAMPLE 1

Graphite fibers (VM 0032, Union Carbide Company) having diameters within the range of 1 to 9 microns were placed in a mixer with aluminum powder (minus 325 mesh) and molten distilled camphene. The graphite fibers constituted 20% by volume of the total fiber-metal powder mixture. The mixture was agitated from between 5 to 15 minutes and then refrigerated until the camphene solidified. The solidified mixture was then extruded four times, and subsequently wrapped in a paper towel and placed in a vacuum chamber. The camphene was then vacuum evaporated, and the dry mixture was then carefully placed in a die cavity. A punch was then inserted into the cavity and the mixture initially compressed at room temperature under at least 500 psi. After initial compression with no added pressure on the punch, the die was heated to above the melting point of the aluminum powder, and the punch was then moved inwardly to decrease the die cavity to at least the cavity size occupied by the mixture at a theoretical 100% density. The cavity was then cooled with the punch in place and the finished billet ejected.

EXAMPLE 2

Silicon carbide fibers (Exxon Enterprises) having diameters within the range of from 500 - 1000 angstroms were placed in a container with aluminum powder (minus 325 mesh) and kneaded together to disintegrate any fiber lumps and to adhere the powder to the fiber. The silicon carbide fibers constituted 20% by volume of the fiber-metal powder mixture, and when kneaded, the extremely fine fibers formed a mixture with the powder having a "dough-like" consistency, thereby eliminating the need for a mixing vehicle such as camphene. This "doughy" mixture was then extruded three times at room temperature and placed in die cavity. A punch was inserted to compress the mixture under at least 500 psi at room temperature, and then, with no added pressure, the die was heated to above the melting point of the aluminum powder. The punch was then moved inwardly to decrease the die cavity in the manner previously described to obtain maximum density, the cavity was cooled and the finished billet ejected.

It has been found that microscopic silicon carbide fibers may be subjected to a pressure of up to 4000 psi during the cold pressure step which is extremely advantageous, for these fibers remain evenly distributed in the metal powder during a cold pressure step. Conversely, if the mixture is first heated to a semi molten state, the movement of the fibers in the semi molten metal is much greater.

A vehicle other than camphene may be employed to cause the metal to adhere to the microscopic fibers to form a billet substantially free of voids. Magnesium powder, which is generally highly flammable, may be alloyed with aluminum to provide such a vehicle.

EXAMPLE 3

Silicon carbide fibers (Exxon Enterprises) having diameters within the range of from 500–1000 angstroms were placed in an iron crucible with magnesium powder (minus 250 mesh) and the mixture was heated in an inert atmosphere to a temperature below the melting point of magnesium but high enough to enhance the evaporation of the magnesium (i.e. 600 degrees C.). The mixture was stirred while heating until the fibers turned brown by the adherence thereto of the evaporating magnesium. Then aluminum powder (minus 350 mesh) was added to the hot mixture and the mixture was stirred until the fibers turned grey. A eutectic forms where the aluminum powder meets the magnesium and the aluminum melts, spreads and adheres. Because the magnesium alloys with the aluminum, the coated fibers are not flammable. The coated fibers are cooled and mixed with a sufficient amount of added aluminum powder so that the fibers constitute substantially 20% by volume of the mixture and the steps of EXAMPLE 2 were then carried out to form a billet.

The novel cold pressing step employed with the method of the present invention makes it unnecessary to subsequently heat the mixture only to a degree necessary to maintain the metal or alloy in a state between the solidus and liquidus thereof. Since cold pressure substantially positions the fibers in their final position in the mixture, the mixture may subsequently be heated to a point far above the melting point of the metal or alloy powder so that the metal or alloy powder is completely molten during the final hot pressing step.

I claim:

1. A process of preparing a fiber-reinforced metal composite which includes dry mixing a metal powder with ceramic fibers to obtain a substantially uniform dispersion of fibers throughout a dry metal-fiber mixture, cold pressing the metal powder-fiber mixture so formed at a first predetermined pressure, heating the pressed metal powder-fiber mixture to a temperature sufficient to permit further densification of the metal powder-fiber mixture, hot pressing the mixture to product further densification thereof, and cooling the resultant composite.

2. The process according to claim 1 wherein said fibers constitute microscopic fibers having a diameter of less than 10 microns.

3. The process according to claim 1 wherein said metal powder and ceramic fibers are mixed and subsequently the mixture is extruded at least three times to obtain a substantially uniform dispersion of fibers throughout the metal power-fiber mixture.

4. The process according to claim 1 wherein the metal powder-fiber mixture is cold pressed at a first predetermined pressure within the range of from 500 to 4000 psi, the resultant pressed metal powder-fiber mixture then being heated to bring the metal powder to a semi molten state.

5. The process according to claim 1 which includes dry mixing a metal powder with ceramic fibers to obtain a dry metal powder-fiber mixture, mixing the dry metal powder-fiber mixture with at least an equal volume of molten distilled camphene and subsequently evaporating the camphene from the resultant mixture.

6. The process according to claim 1 which includes dry mixing a metal powder with ceramic fibers to obtain a dry metal powder-fiber mixture, mixing the dry metal powder-fiber mixture with a molten distilled camphene, cooling the resultant mixture, extruding the cooled mixture at least three times, and subsequently evaporating the camphene from the mixture to obtain a substantially uniform dispersion of fibers throughout the metal powder-fiber mixture.

7. The process according to claim 6 wherein said ceramic fibers constitute fibers having a diameter of less than 10 microns, said metal powder-fiber mixture being cold pressed at a pressure between 500 and 4000 psi and the pressed mixture being subsequently heated to bring the metal powder to a semi molten state for hot pressing.

8. The process according to claim 7 wherein the ceramic fibers constitute either graphite or silicon carbide fibers and said metal powder constitutes aluminum powder of less than minus 200 mesh, said ceramic fibers forming from 10% to 30% by volume of the total metal powder-fiber mixture.

9. The process according to claim 1 wherein said ceramic fibers are microscopic fibers having a diameter of less than 10 microns and said metal powder is less than minus 200 mesh, the ceramic fibers constituting between 10 and 30% by volume of the metal powder-fiber mixture, said metal powder-fiber mixture being cold pressed by placing the mixture in a die cavity, introducing a ram into the die cavity against the mixture to cold press the mixture at a first predetermined pressure within the range of from 500 to 4000 psi, maintaining the ram against the press mixture while heating the mixture to a temperature sufficient to bring the metal powder to a semi molten state, and subsequently hot pressing the heated mixture with the ram to produce further densification thereof.

10. The process according to claim 1 wherein said metal powder-fiber mixture with a substantially uniform fiber dispersion is obtained by mixing said ceramic fibers with magnesium powder, heating the mixture in an inert atmosphere to evaporate the magnesium and form a coating thereof on said ceramic fibers, mixing the magnesium coated fibers with a metal powder to alloy the metal powder with the magnesium, and subsequently adding additional metal powder to obtain a substantially uniform dispersion of fibers throughout the metal powder-fiber mixture.

11. The process according to claim 10 wherein said metal powder is aluminum powder and said ceramic fibers constitute from 10 to 30% by volume of the total volume of the aluminum powder-fiber mixture.

* * * * *